US011140489B2

(12) United States Patent
Chen et al.

(10) Patent No.: US 11,140,489 B2
(45) Date of Patent: Oct. 5, 2021

(54) SPEAKER

(71) Applicant: AAC Technologies Pte. Ltd., Singapore (SG)

(72) Inventors: Minmin Chen, Shenzhen (CN); Xun Di, Shenzhen (CN); Bin Zhao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 146 days.

(21) Appl. No.: 16/711,398

(22) Filed: Dec. 11, 2019

(65) Prior Publication Data

US 2020/0213749 A1 Jul. 2, 2020

(30) Foreign Application Priority Data

Dec. 30, 2018 (CN) ..... 201822275870.6

(51) Int. Cl.
*H04R 9/02* (2006.01)
*H04R 1/02* (2006.01)
*H04R 9/06* (2006.01)

(52) U.S. Cl.
CPC ..... *H04R 9/025* (2013.01); *H04R 1/026* (2013.01); *H04R 9/06* (2013.01); *H04R 2209/041* (2013.01)

(58) Field of Classification Search
CPC combination set(s) only.
See application file for complete search history.

(56) References Cited

U.S. PATENT DOCUMENTS 8,213,644 B2 * 7/2012 Choi ..... H04R 9/06 381/151
10,728,672 B2 * 7/2020 Kim ..... H04R 9/045
2004/0070294 A1 * 4/2004 Hanada ..... H04R 9/047 310/81
2016/0227326 A1 * 8/2016 Mao ..... H04R 9/066
2016/0381462 A1 * 12/2016 Wang ..... H04R 9/025 381/398

* cited by examiner

*Primary Examiner* — Duc Nguyen
*Assistant Examiner* — Assad Mohammed
(74) *Attorney, Agent, or Firm* — W&G Law Group

(57) ABSTRACT

A speaker includes a frame; a magnetic circuit system in the frame; and a vibrating system in the frame. The vibrating system includes a suspension ring fixed on the frame, a number of domes fixed at a center of the suspension ring and a voice coil connected below the domes. The domes includes a first dome and a second dome stacked with each other. The second dome has a body part and a number of convex parts extending from the body part to the magnetic circuit system; a number of intervals each formed between every two contiguous convex parts. The convex part includes a bottom surface close to the magnetic circuit system. The voice coil buts the bottom surface and forms leakage passages with the second dome at the interval positions.

18 Claims, 6 Drawing Sheets

SPEAKER

FIELD OF THE PRESENT DISCLOSURE

The present invention relates to the field of electro-acoustic transducers, and more particularly to a speaker.

DESCRIPTION OF RELATED ART

With the continuous increase of market demand, electronic devices such as mobile phones, etc., are gradually developing towards thin type, and their sound quality is required to be better and better, which requires the acoustic devices in mobile phones to develop towards the direction of micro-size, thin type and high sound quality. Diaphragm is the core component of the speaker and other acoustic devices, so the requirement on its acoustic performance increases accordingly.

The speaker of relevant technologies comprises a frame, and a magnetic circuit system and a vibrating system in the frame, wherein the vibrating system comprises a diaphragm fixed on the frame and a voice coil fixed on the frame. The voice coil is inserted in the magnetic gap of the magnetic circuit system and directly butts the diaphragm. In the speaker structure, the voice coil directly butts and fully fits the diaphragm at the butting position, and therefore, the voice coil needs to be elongated to ensure magnetic flux to guarantee enough space between the magnetic bowl and the dome in the thin-type development process of the speaker. A larger space is needed after the amplitude of the diaphragm increases, the air current in the voice coil cannot circulate in time, and the strength of a conventional alloy dome is insufficient, thus, the speaker performance is influenced to decrease.

Thus, it is necessary to provide a novel speaker to solve the problems above.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

Figure 1:
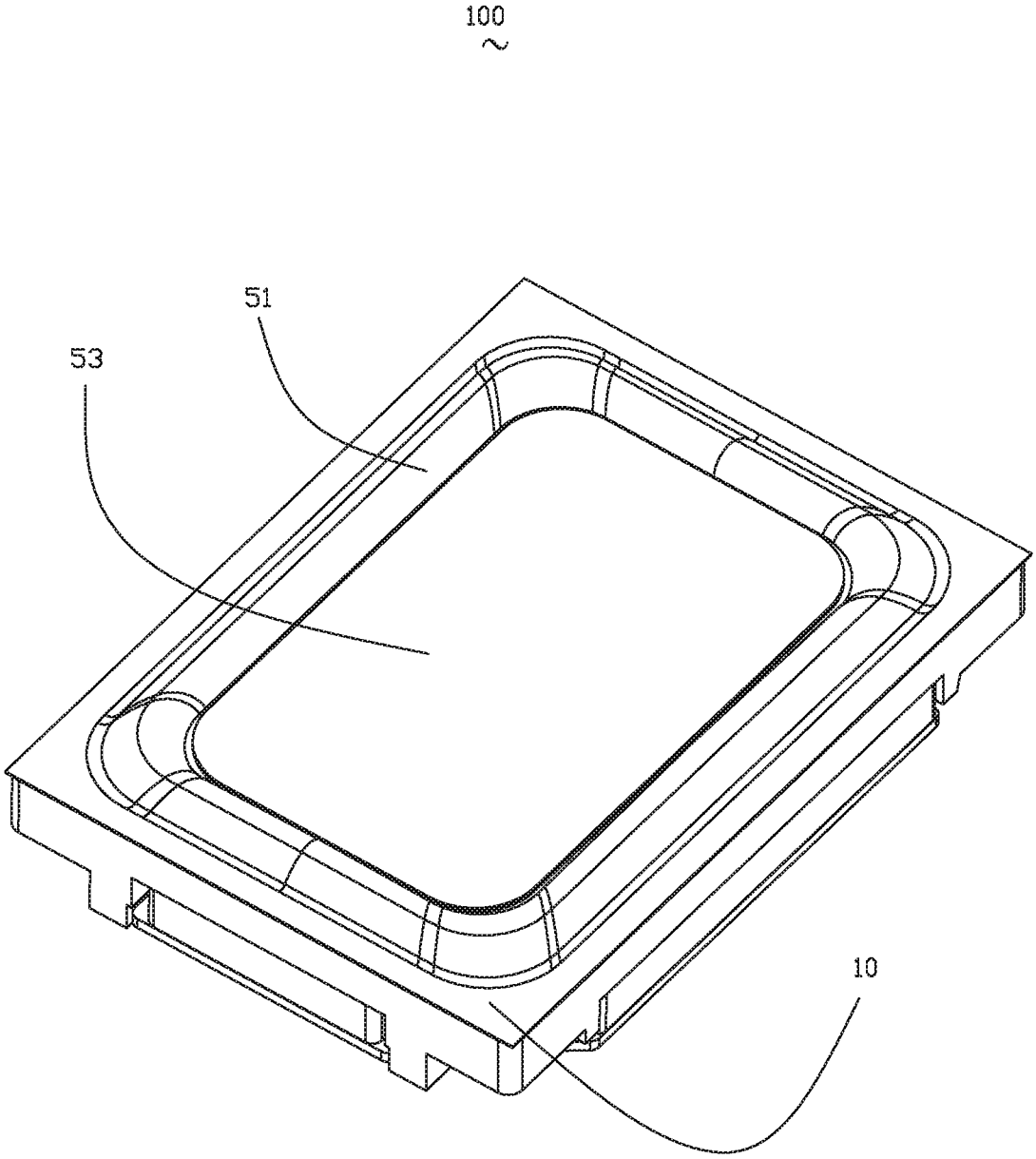
FIG. 1 is an isometric view of a speaker in accordance with a first embodiment of the present invention.
Figure 2:
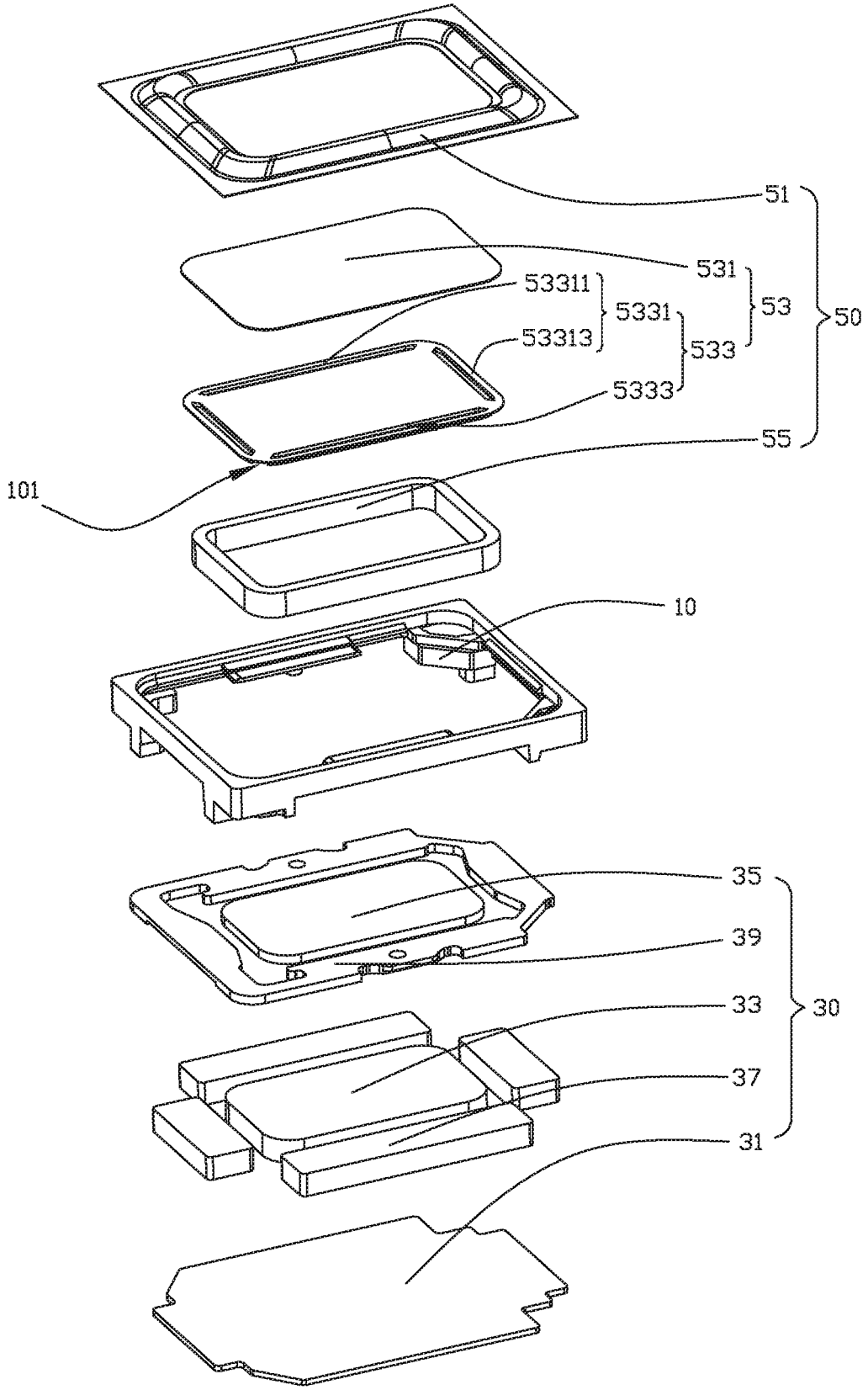
FIG. 2 is an exploded view of the speaker in FIG. 1.
Figure 3:
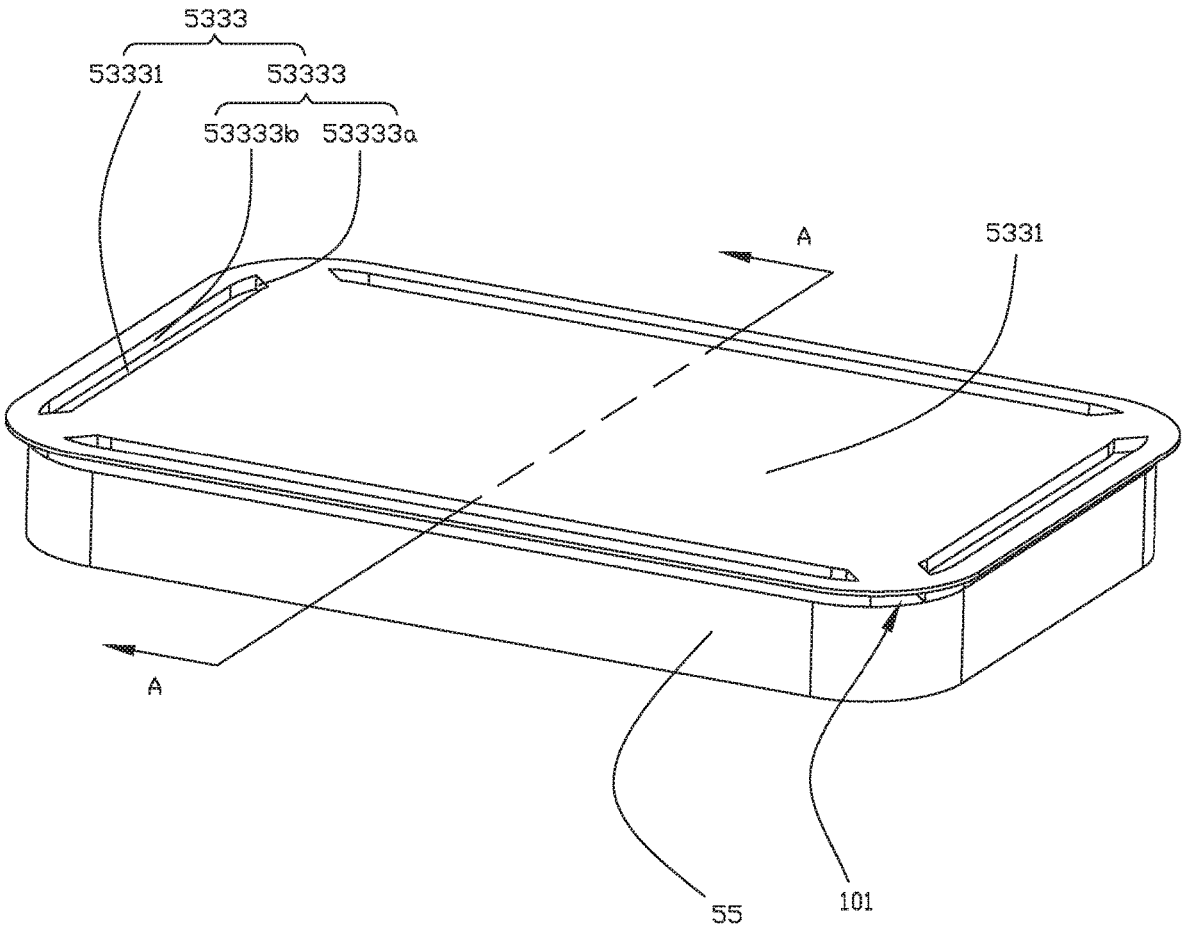
FIG. 3 is an assembled view of a second dome and a voice coil of the speaker of the first embodiment.
Figure 4:
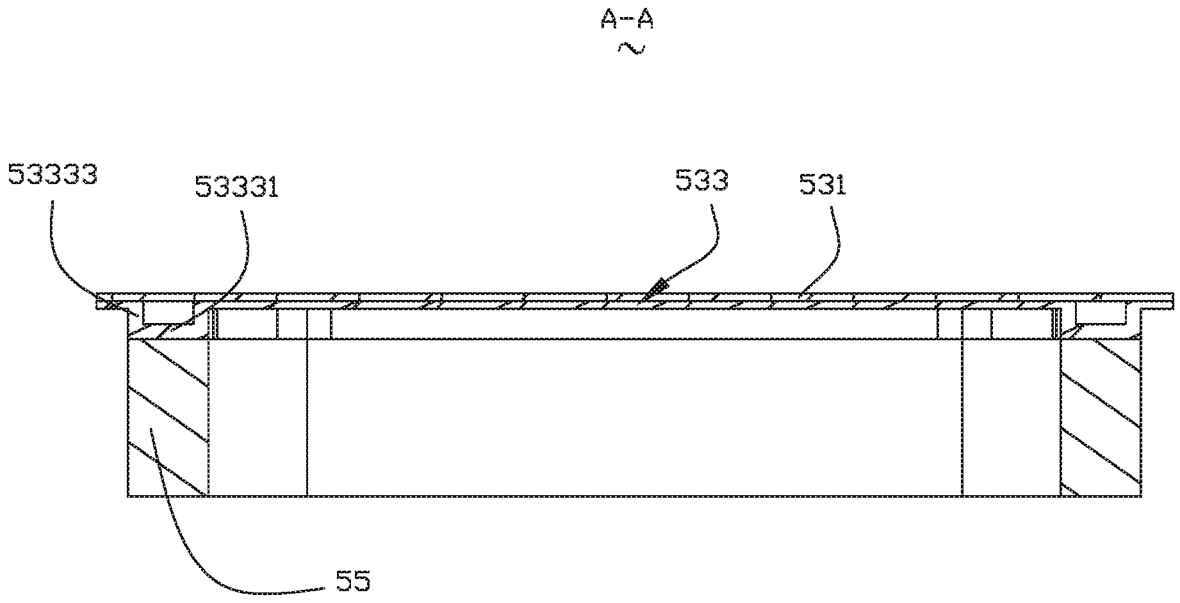
FIG. 4 is a cross-sectional view of FIG. 3 taken along line A-A.

The present disclosure will hereinafter be described in detail with reference to several exemplary embodiments. To make the technical problems to be solved, technical solutions and beneficial effects of the present disclosure more apparent, the present disclosure is described in further detail together with the figures and the embodiments. It should be understood the specific embodiments described hereby are only to explain the disclosure, not intended to limit the disclosure.

Embodiment 1

Please refer to FIGS. 1-4, the present invention provides a speaker 100. The speaker 100 comprises a frame 10, and a magnetic circuit system 30 and a vibrating system 50 arranged in the frame 10.

The magnetic circuit system 30 comprises a magnetic bowl 31, a main magnet 33 arranged in the magnetic bowl 31, a magnetic guide plate 35 arranged above the main magnet 33, an auxiliary magnet 37 enclosing around the main magnet 33, and an upper splint 39 arranged above the auxiliary magnet 37, wherein, the main magnet 33 and the auxiliary magnet 37 form a magnetic gap.

The vibrating system 50 comprises a suspension ring 51 fixed on the frame 10, domes 53 fixed at the center of the suspension ring 51 and a voice coil 55 connected under the domes 53. The voice coil 55 is inserted into the magnetic gap and drives the dome 53 to vibrate for sounding.

The domes 53 comprise a first dome 531 and a second dome 533 which are piled up in order, wherein, the first dome 531 and the second dome 533 are fixedly connected by hot pressing or gluing, and the two domes increase the strength of the whole vibrating system.

The second dome 533 comprises a body part 5331 and a plurality of convex parts 5333 extending from the body part 5331 to a magnetic circuit system 30. Intervals 101 are formed between every two contiguous convex parts 5333. Description is as follows: in the embodiment, the second dome 533 forms the convex parts 5333 by stamping, namely, the side of the body part 5331 far away from the convex parts 5333 correspondingly forms grooves matching the convex parts 5333. In addition, foam, glue, rubber, veneer or other damping material is filled in the grooves, which can increase the damping performance of the vibrating system 50 and further modulate the performance of the speaker 100.

The body part 5331 is in a fillet rectangle structure. Specifically, the body part 5331 comprises long axis edges 53311 oppositely arranged and short axis edges 53313 connected with the long axis edges 53311. The convex parts 5333 are arranged at the edges of the long axis edges 53311 and/or short axis edges 53313. Each interval 101 is located between two of the convex parts 5333. Of course, the above doesn't limit the present invention. In other embodiments, the convex parts 5333 can be correspondingly arranged at the corners of the body part 5331.

The convex parts 5333 comprise a bottom surface 53331 close to the magnetic circuit system 30 and side wall surfaces 53333 extending from the body part 5331 towards the magnetic circuit system 30. The side wall surfaces 53333 and the bottom surface 53331 together enclose to form the convex parts 5333. In the embodiment, each side wall surface 53333 comprises two first side wall surfaces 53333*a* and a second side wall surface 53333*b* connected with the first side wall surfaces 53333*a*, wherein, the first side wall surfaces 53333*a* are oppositely arranged and incline towards the geometric center of the body part 5331. The plane where the two first side wall surfaces 53333*a* are located intersects the inside of the body part 5331.

The bottom surface 53331 of the convex parts 5333 butts the voice coil 55 and forms leakage passages 102 with the second dome 533 at the interval positions 101. After arranging the leakage passages 102, the air current in the voice coil 55 can circulate in time through the leakage passages 102, and the inner and outer air pressure difference of the voice coil 55 can be effectively decreased after the amplitude of the vibrating system 50 increases, and therefore, the influence on the performance of the speaker 100 imposed by the inner and outer air pressure imbalance of the voice coil 55 is avoided.

Preferably, in the embodiment, four convex parts 5333 are arranged and respectively located at the two long axis edges 53311 and the two short axis edges 53313, and parallel to the corresponding long axis edge 53311 or short axis edge 53313 where the convex parts 5333 are located. In addition, the two convex parts 5333 located at the long axis edges 53311 are symmetrically distributed along the perpendicular bisector of the short axis edges 53313, and the two convex parts 5333 located at the short axis edges 53313 are symmetrically distributed along the perpendicular bisector of the long axis edges 53311. With the arrangement, only a few convex parts 5333 are needed on the second dome 533 to more firmly glue the voice coil 55 with the bottom surface 53331 of the convex parts 5333.

Preferably, the convex parts 5333 are 10 to 3000 um high. The height is equal to the distance of the convex parts 5333 extending from the body part 5331 to the magnetic circuit system 30. Over-low height causes over-small leakage passages 102 formed between the voice coil 55 and the second dome 533, and the air current in the voice coil 55 cannot circulate well in time. Over-high height causes the convex parts 5333 occupy excessive space where the voice coil 55 is arranged, and then the volume of the voice coil 55 is limited, which is disadvantageous to get high magnetic flux.

Preferably, the convex parts 5333 are 100 to 1000 um wide, which matches the thickness of the common voice coil 55. Over-small width decreases the gluing area between the voice coil 55 and the second dome 533, and then the voice coil 55 cannot be firmly adhered to the second dome 533, which is disadvantageous to the reliability of the whole speaker 100. Over-big width doesn't clearly influence the gluing of the voice coil 55, however, setting big width for the convex parts 5333 is not necessary.

Preferably, the body part 5331 is 50 to 500 um thick. The thickness of the body part 5331 is controlled within the range so that the strength of the whole dome structure is enhanced besides ensuring the gluing effect between the second dome 533 and the first dome 531. More preferably, the body part 5331 is 80 to 200 um thick.

Based on the structure above, in the embodiment, the first dome 531 is made of woven cloth, carbon fiber, the composite material of carbon fiber and foaming material or prepreg resin material, such as epoxy resin, PEEK, polyimide, polyphenylene sulfide, PBO, aramid 1414, etc. The second dome 533 is made of the alloy material such as aluminum alloy, magnesium alloy, magnesium-lithium alloy or titanium alloy or the composite material of aluminum foil or copper foil and foaming material, wherein, the foaming material is polymethylacrylimide, methyl cyclopentenolone, foaming polyphenylene sulfide or foaming polyimide.

Embodiment 2

Figure 5:
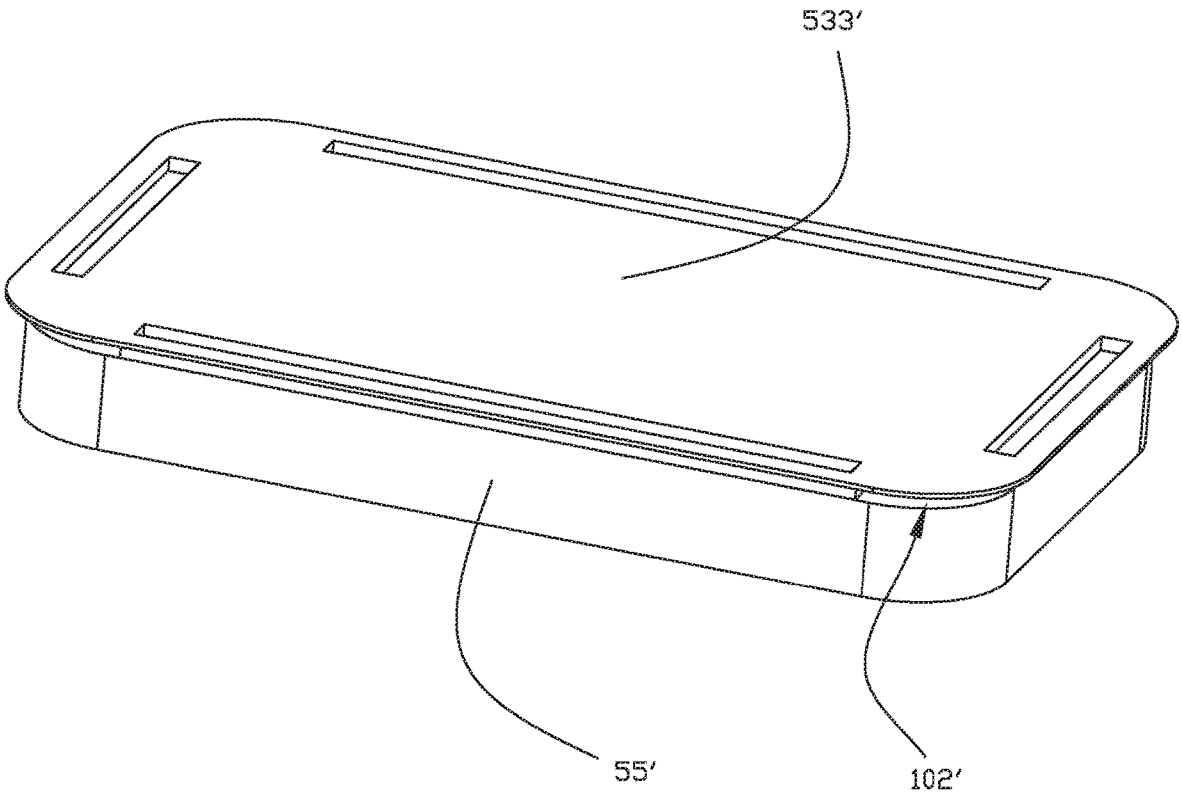
FIG. 5 is an isometric and assembled view of a second dome and a voice coil of a speaker in accordance with a second exemplary embodiment of the present invention.
Figure 6:
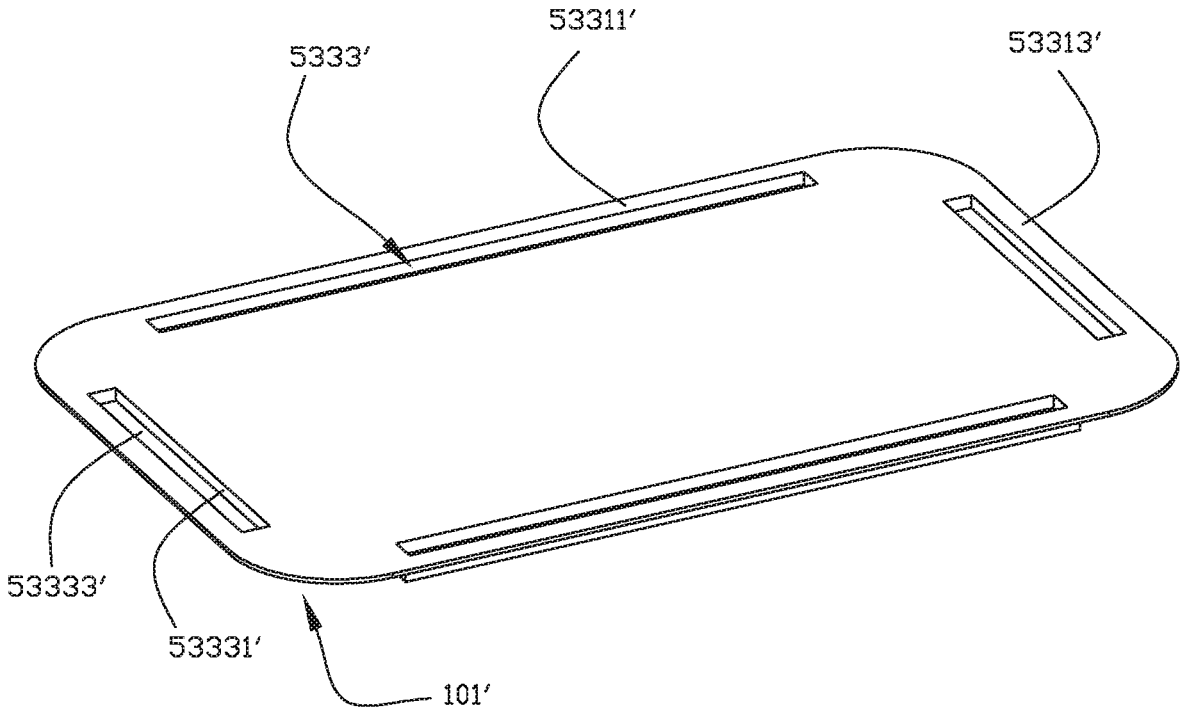
FIG. 6 is an isometric view of the second dome of the speaker of the second embodiment.

Please refer to FIGS. 5-6, the structure of the speaker provided by the embodiment is basically the same as the structure of the speaker 100 provided by embodiment 1. The difference is that the convex parts 5333' comprise side wall surfaces 53331' extending from the body part towards the direction of the magnetic circuit system, and a bottom surface 53333' close to the magnetic circuit system. The side wall surfaces 53331' and the bottom surface 53333' together enclose to form the convex parts 5333'. For the side wall surfaces 53331', two side wall surfaces 53331' oppositely arranged are mutually parallel, namely, compared with embodiment 1, in the embodiment, the two side wall surfaces 53331' oppositely arranged are mutually parallel, and the four convex parts 5333' are respectively parallel to the long axis edges 53311' or short axis edges 53313' where the convex parts 5333' are located. The two convex parts 5333' located on the long axis edges 53311' are symmetrically distributed along the perpendicular bisector of the short axis edges 53313', and the two convex parts 5333' located at the short axis edges 53313' are symmetrically distributed along the perpendicular bisector of the long axis edges 53311'. Every two contiguous convex parts 5333' are not connected but provided with an interval 101'. The voice coil 55' butts the bottom surfaces 53333' of the convex parts 5333' and forms leakage passages 102' with the second dome 533' at the position where the convex parts 5333' form intervals 101'.

Compared with relevant technologies, the speaker of the present invention has the following advantages: the second dome is arranged between the first dome and the voice coil, the convex parts are arranged on the second dome, and the voice coil forms the leakage passages helpful for air current circulation with the clearances among the convex parts, which makes the air current in the voice coil can circulate in time through the leakage passages, and the inner and outer air pressure difference of the voice coil can be effectively decreased after the amplitude of the vibrating system increases, and therefore, the influence on the performance of the speaker imposed by the inner and outer air pressure imbalance of the voice coil is avoided. At the same time, compared with the arrangement that the voice coil directly butts the first dome, although the convex parts occupy some space where the voice coil is arranged, the voice coil becomes lower and thicker, which both decreases the speaker thickness and increases the magnetic flux. In addition, although the single dome enhances the strength of the dome besides not increasing the dome thickness by arranging the convex parts extending towards the magnetic circuit system, the structural strength of the dome at the convex part positions is difficult to be ensured if no material is filled in the grooves corresponding to the convex parts. Thus, the arrangement of the first dome and the second dome in cooperation also ensures the structural strength of the dome when no damping material is filled in the grooves of the dome, which increases the structural strength of the vibrating system itself and makes the micro-type speaker still keep excellent and reliable performance.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker including:

a frame;

a magnetic circuit system in the frame;

a vibrating system in the frame, including a suspension ring fixed on the frame, a plurality of domes fixed at a center of the suspension ring and a voice coil connected below the domes;

the domes comprising a first dome and a second dome stacked with each other, wherein the second dome comprises a body part and a plurality of convex parts extending from the body part to the magnetic circuit system; a plurality of intervals each formed between every two contiguous convex parts; the convex part comprise a bottom surface close to the magnetic circuit system; the voice coil buts the bottom surface and forms leakage passages with the second dome at the interval positions.

2. The speaker according to claim 1, wherein the body part is in a fillet rectangle structure, the body part comprises a pair of long axis edges and a pair of short axis edges connected with the long axis edges; the convex parts are arranged at the edges of the long axis edges and/or short axis edges' each interval is located between two of the convex parts.

3. The speaker according to claim 2, wherein the convex part further comprises side wall surfaces extending from the body part towards the magnetic circuit system; the side wall surfaces and the bottom surface together enclose to form the convex parts; each side wall surface comprises two first side wall surfaces and a second side wall surface connected with the first side wall surfaces; the first side wall surfaces are oppositely arranged and incline towards a geometric center of the body part; the plane where the two first side wall surfaces are located intersects the inside of the body part.

4. The speaker according to claim 2, wherein the convex part further comprises side wall surfaces extending from the body part towards the magnetic circuit system; the side wall surfaces and the bottom surface together enclose to form the convex parts; the two side wall surfaces are parallel to each other.

5. The speaker according to claim 3 comprising four convex parts arranged and respectively distributed symmetrically along the perpendicular bisector of the long axis edges and/or the perpendicular bisector of the short axis edges.

6. The speaker according to claim 4 comprising four convex parts arranged and respectively distributed symmetrically along the perpendicular bisector of the long axis edges and/or the perpendicular bisector of the short axis edges.

7. The speaker according to claim 3 comprising four convex parts respectively parallel to the long axis edges or short axis edges where the convex parts are located.

8. The speaker according to claim 4 comprising four convex parts respectively parallel to the long axis edges or short axis edges where the convex parts are located.

9. The speaker according to claim 7, wherein the convex parts are 10 to 3000 um high.

10. The speaker according to claim 8, wherein the convex parts are 10 to 3000 um high.

11. The speaker according to claim 7, wherein the convex parts are 100 to 1000 um wide.

12. The speaker according to claim 8, wherein the convex parts are 100 to 1000 um wide.

13. The speaker according to claim 9, wherein the body part is 50 to 500 um thick.

14. The speaker according to claim 10, wherein the body part is 50 to 500 um thick.

15. The speaker according to claim 11, wherein the body part is 50 to 500 um thick.

16. The speaker according to claim 12, wherein the body part is 50 to 500 um thick.

17. The speaker according to claim 1, wherein the first dome is made of woven cloth, carbon fiber, the composite material of carbon fiber and foaming material or prepreg resin material selected from at least one of epoxy resin, PEEK, polyimide, polyphenylene sulfide, PBO, aramid; the second dome is made of alloy material selected from aluminum alloy, magnesium alloy, magnesium-lithium alloy or titanium alloy or the composite material of aluminum foil or copper foil and foaming material.

18. The speaker according to claim 1, wherein the second dome forms the convex parts by stamping; the side of the body part far away from the convex parts correspondingly forms grooves matching the convex parts for filling in foam, glue, rubber, veneer or other damping material.

* * * * *